US005153046A

United States Patent [19]

Murphy

[11] Patent Number: 5,153,046

[45] Date of Patent: Oct. 6, 1992

[54] FLUOROCHEMICAL COMPOSITION FOR IMPARTING ANTISOILING PROTECTION AND LUBRICITY TO TEXTILE FIBERS

[75] Inventor: Peter M. Murphy, Seaford, Del.

[73] Assignee: E. I. Du Pont de Nemours and Company, Wilmington, Del.

[21] Appl. No.: 527,807

[22] Filed: May 24, 1990

[51] Int. Cl.[5] ..... B32B 3/02; B32B 27/34; D02G 3/00; D06M 00/00

[52] U.S. Cl. ..... 428/96; 252/8.6; 252/8.8; 428/378; 428/395; 427/393.4

[58] Field of Search ..... 252/8.6, 8.8; 427/393.4; 428/96

[56] References Cited

U.S. PATENT DOCUMENTS

| | | | |
|---|---|---|---|
| 3,645,989 | 2/1972 | Tandy, Jr. | 428/290 |
| 4,029,585 | 6/1977 | Dettre et al. | 252/8.6 |
| 4,192,754 | 3/1980 | Marshall et al. | 252/8.8 |
| 4,416,787 | 11/1983 | Marshall et al. | 252/8.8 |
| 4,566,981 | 1/1986 | Howells | 252/8.8 |
| 4,668,406 | 5/1987 | Chars | 252/8.75 |
| 4,695,497 | 9/1987 | Nagy | 428/96 |
| 4,958,039 | 9/1990 | Pechhold | 556/421 |

FOREIGN PATENT DOCUMENTS

| | | |
|---|---|---|
| 59-228075 | 12/1984 | Japan . |
| 59-228076 | 12/1984 | Japan . |

*Primary Examiner*—George F. Lesmes
*Assistant Examiner*—Chris Raimund

[57] ABSTRACT

An aqueous fluorochemical finish composition for imparting antisoiling protection to textile fibers, e.g. nylon yarns, is composed of fluorochemical textile antisoilant, lubricant and a combination of cationic and nonionic surfactants.

11 Claims, No Drawings

FLUOROCHEMICAL COMPOSITION FOR IMPARTING ANTISOILING PROTECTION AND LUBRICITY TO TEXTILE FIBERS

BACKGROUND OF THE INVENTION

1. Field of the Invention

This invention relates to a fluorochemical composition for imparting antisoiling protection and lubricity to textile fibers. More particularly, this invention relates to a finish composition which provides the fibers with antisoil protection and frictional characteristics, which is durable to washing and dyeing, and which is stable to the high shear environment of a finish application system.

2. Description of Related Art

The treatment of fibers and textiles with compositions containing fluorochemicals in order to make the fiber or textile both oil and water repellent as well as soil resistant has been known for some time. Illustrative of prior art patents describing such treatments are: U.S. Pat. Nos. 4,134,839, 4,192,754, 4,566,981, 4,695,497, 4,416,787, 3,923,715, 4,029,585 and 4,668,406.

The fluorochemicals are generally applied either as a topical treatment to the completed textile fabric or carpet or as a finish on the textile fiber itself, i.e. to a continuous filament yarn during its manufacture. Both forms of application suffer from certain disadvantages. Topical treatments tend to concentrate the fluorochemical on the surface of the textile fabric or carpet such that the fluorochemical may not penetrate to the interior of a heavy fabric or to the base of a carpet. Furthermore, it is often difficult to topically apply fluorochemicals evenly across a textile fabric or carpet and the result is that streaking may occur.

The application of fluorochemicals as finishes to textile fibers such as continuous filament yarns tends to be more expensive than topical treatment. The reason is that the finishes can hydrolyze or otherwise degrade, wash off or burn off during subsequent textile processing, e.g. during twisting, heat setting, carding, spinning, weaving, scouring or dyeing steps. Processing steps that involve elevated temperatures are especially troublesome. In any event, more fluorochemical must normally be applied to the fiber in order to achieve the same level on the final product than would be the case if a topical application was being made to a fabric.

Since fluorochemicals alone do not usually provide textile fibers with the necessary friction characteristics for the customary textile processing steps, they must be mixed with other lubricants when applied as a finish. Mixtures based on fluorochemicals and lubricants tend to be relatively unstable. Often they will separate, change in appearance or in viscosity while merely sitting in storage tanks or while being pumped under shear through a finish application system. While surfactants may improve stability somewhat, many fluorochemicals require expensive fluorine-based surfactants in order to achieve a sufficiently stable finish. These surfactants largely wash off during textile processing and do not contribute to the total fluorine level on the textile product.

An object of this invention is, therefore, an aqueous water-based fluorochemical composition for imparting antisoiling protection along with the necessary frictional characteristics to textile fibers and which is stable to the high shear environment of a fiber finish application system. Still another object is the provision of such a composition without the use of expensive fluorine-based surfactants. A further object is such a composition which is also durable to washing and dyeing in order to perform effectively in the ultimate finished textile article.

SUMMARY OF THE INVENTION

The present invention provides a fluorochemical finish composition for imparting antisoiling protection and lubricity to textile fibers and which is stable to the high shear environment of a finish application system. More particularly, the composition has a pH less than 6 and is a uniform aqueous emulsion containing about 2 to 30 weight % active ingredients and is substantially free of fluorine-containing surfactants, said active ingredients comprising on a dry solids weight basis about:

(a) 1 to 35% of nonionic fluorochemical textile antisoilant;

(b) 65 to 95% of nonionic water-soluble or water-emulsifiable lubricant;

(c) 0.05 to 15% of quaternary ammonium or protonated amine cationic surfactant; and (d) 0.05 to 15% of nonionic surfactant, the weight ratio of antisoilant to total surfactants being about 0.5 to 20:1 and the weight ratio of lubricant to antisoilant being about 2 to 25:1.

The invention also provides textile fibers such as polyamides having incorporated therewith the above described fluorochemical finish compositions. Generally the fibers should be coated with at least about 0.2% by weight of the composition on a dry weight basis and the level of fluorine present to achieve adequate soil resistance should be at least 200 ppm based on the fiber weight.

It has been found in accordance with the invention that the aforementioned compositions are particularly effective for imparting antisoiling protection to textile fibers such as continuous filament yarns. Significantly they are highly stable to the high shear environment of a finish application system as well as to elevated temperatures. It is particularly important that the composition have a pH less than 6, and that a combination of cationic surfactant and nonionic surfactant be employed.

DETAILED DESCRIPTION OF THE INVENTION

The aqueous fluorochemical finish compositions contain active ingredients (or "AI") which are composed on a weight basis of about:

1 to 35%, preferably 5 to 20%, of at least one fluorochemical textile antisoilant;

65 to 95%, preferably 70 to 85%, of at least one nonionic water-soluble or water-emulsifiable lubricant;

0.05 to 15%, preferably 0.2 to 5%, of at least one quaternary ammonium or protonated amine cationic surfactant; and 0.05 to 15%, preferably 0.2 to 5%, of at least one nonionic surfactant. The weight ratio of antisoilant to total surfactants is about 0.5 to 20:1, preferably about 1 to 4:1. The weight ratio of lubricant to antisoilant is about 2 to 25:1, preferably about 4 to 8:1. Preferably the compositions consist essentially of water and the aforementioned components. The surfactants in the composition are non-fluorine containing surfactants. Not only are the fluorine-containing surfactants relatively costly, but in addition they can adversely affect emulsion stability, as will be seen from Control A in the Table of Examples below. Typical examples of fluorine-containing surfactant that have previously been used in finishes of the prior art include the fluorinated alkyl polyoxyethylene ethanols.

If the compositions as prepared do not have a pH less than 6, then they should be adjusted with acid to be less than 6. Preferably the adjustment will be to a pH between 3 and 5, in order to minimize corrosion of metallic materials in contact with the finish. Any mineral acid or non-fatty organic acid may be used to adjust the pH. Examples of such acids include sulfamic acid, phosphoric acid and formic acid.

It will be understood that instead of using a single fluorochemical textile antisoilant, mixtures of such antisoilants can be used. Similarly, mixtures of lubricants and mixtures of cationic and nonionic surfactants can be used.

The fluorochemical textile antisoilants employed in the invention are well known. They are water insoluble soil repellants and have one or more fluoroaliphatic radicals, typically one or more perfluoroalkyl radicals. They are nonionic in that they do not contain an ionized functional group such as a quaternary ammonium group. Preferred classes of the antisoilants are the fluorocarbonylimino biurets, the fluoroesters, the fluoroester carbamates, and the fluoropolymers.

The class of fluorocarbonylimino biurets is represented by U.S. application Ser. No. 06/644,089 (Pechhold), now U.S. Pat. No. 4,958,039 filed Aug. 24, 1984, the disclosure of which is incorporated herein by reference. As an example, mention is made of the reaction product of two moles of a mixture of fluoroalcohols of the formula $F(CF_2CF_2)_nCH_2CH_2OH$, where n is predominantly 5, 4 and 3, with one mole of 1,3,5-tris(6-isocyanotohexyl)biuret having the structure

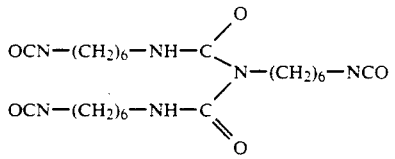

followed by reaction of residual isocyanate groups with a modifier such as 3-chloro-1,2-propanediol. This reaction product is referred to as FA-1 hereafter. The class of fluorocarbonylimino biurets is particularly preferred because of the outstanding antisoilant protection it provides.

The class of fluoroesters is represented by U.S. Pat. No. 3,923,715 (Dettre) and U.S. Pat. No. 4,029,585 (Dettre), the disclosures of which are incorporated herein by reference. These patents disclose perfluoroalkyl esters of carboxylic acids of 3 to 30 carbon atoms. An example is the citric acid ester of perfluoroalkyl aliphatic alcohols such as a mixture of 2-perfluoroalkyl ethanols containing 8 to 16 carbon atoms. This ester is referred to as FA-2 hereafter.

The class of fluoroester carbamates is also disclosed in aforementioned U.S. Pat. No. 4,029,585. An example is the citric acid urethane obtained by reacting the citric acid ester mentioned above with 1-methyl-2,4-diisocyanatobenzene. This urethane is referred to as FA-3 hereafter.

The class of fluoropolymers is represented by U.S. Pat. No. 3,645,989 (Tandy) and U.S. Pat. No. 3,645,990 (Raynolds), the disclosures of which are incorporated herein by reference. The patents describe, respectively, fluorinated polymers from acrylic and methacrylic derived monomers having the structures $$CH_2{=}CH{-}CO_2CH_2CH_2R_f$$

and $$CH_2{=}C(CH_3){-}CO_2CH_2CH_2R_f$$

where $R_f$ is a perfluoroalkyl group of about 4 through 14 carbons, and methyl acrylate or ethyl acrylate, optionally with small amounts of other monomers. An example of such a fluoropolymer is the copolymer of the last mentioned formula, wherein $R_f$ is a mixture of perfluoroaliphatic radicals of 8 to 16 carbons, with methyl methacrylate in a 74:26 weight ratio. This polymer is referred to as FA-4 hereafter.

The fluorochemical textile antisoilants as prepared may contain some amount of surfactants, but usually the amounts are small. Hence, in making the fluorochemical finishes, it is usually necessary to add both cationic and nonionic surfactants to achieve an adequate level.

The lubricants are nonionic water-soluble or water-emulsifiable lubricants conventionally used in the textile industry. These classes are particularly suitable because of their hydrodynamic friction characteristics as well as their compatibility with the fluorochemical textile antisoilant. A typical and preferred example of a water-soluble lubricant is PEG-600 monolaurate, i.e. polyethylene glycol of 600 MW esterified with lauric acid. Other examples include glycerol monooleate condensed with ethylene oxide and propylene oxide and PEG-400 monopelargonate which is methoxy capped.

Water-emulsifiable lubricants fall generally into several categories such as naturally occurring animal and vegetable oils, petroleum distillates, and synthetic esters. Typical examples include coconut oil (emulsified with ethoxylated castor oil, which itself has been formed in a 1:25 mole ratio with ethylene oxide), 60 SUS viscosity white oil; and isobutyl stearate (emulsified with ethoxylated oleyl alcohol, formed in a 1:10 mole ratio with ethylene oxide).

Lubricants with a hydrophile-lipophile balance (HLB) of about 11-18, preferably 14-17, form the most stable finishes. As is known, HLB is an expression of the hydrophile-lipophile balance of an emulsifier, i.e. the relative size and strength of the polar and non-polar portions of the molecule. HLB is further defined in *Surfactant Science and Technology* D. Myers, pp 235-245, 1988, VCH Publishers, New York.

Examples of the type of quaternary ammonium or protonated amine cationic surfactants employed in the invention are trimethyldodecylammonium chloride, trimethylhexadecylammonium chloride, dimethyldicocoammonium chloride, and dimethyl octadecylammonium acetate.

Examples of the type of nonionic surfactants employed in the invention are etherification products of ethylene oxide and/or propylene oxide with glycerol monooleate, oleic acid, cetyl alcohol, pelargonic acid, stearyl alcohol, sorbitan monooleate, sorbitan monostearate.

In general, the finishes of the invention are made in the conventional manner by dissolving or emulsifying the lubricant and surfactants in water, adding the fluorochemical textile antisoilant, and adjusting the pH, if needed, to below 6. Likewise they are applied to textile fibers in the conventional manner, e.g., by means of dip pans, foam or roller applicators, or sprayers followed by drying, usually at 50° C. or higher to deposit a uniform coating on the fiber.

As will be understood by those skilled in the art, there are a number of general considerations that apply to the preparation and use of the finish compositions of the invention. Several of these will be mentioned.

In general, for example, it may be desirable to maintain a relatively high level of total A.I. in the finish compositions in order to facilitate the application of high levels to textile fibers. However, the compositions, being oil-in-water emulsions tend to be destabilized at higher solids contents. While increasing the level of surfactants can generally improve stability, the effect is much more pronounced at lower surfactant levels. Since the surfactants can represent a significant cost factor, it is desirable to keep their level to a minimum for that reason as well.

Thus, in general the formulator will understand that depending upon the particular application intended, a balance must be achieved between the selection and levels of the components of the finish compositions. Numerous factors such as level of antisoiling protection and lubricity, cost, toxicity and environmental impact, will have to be weighed in arriving at a specific formulation.

In the examples the following tests are used to evaluate the finish compositions:

PUMP DEPOSITS - The finish (800 g) is recirculated through a Micropump ® pump (model #120-411-10A) for 15 minutes while the pump is suspended in a cooling bath at 20°-25° C. The Micropump ® is a gear pump with a high degree of shear. The flow through the pump is regulated to be about 2000 g/minute. After pumping, the pump is rinsed with water. The pump is then rinsed with Freon ® TF solvent ($CCl_2F$-$CClF_2$) to dissolve any deposits. The solvent is evaporated and the deposits are weighed. The amount of deposits (and the finish stability after pumping) are indicative of the finish's long term performance through high shear metering pumps. Generally the amount of deposits should be less than 50 mg., preferably be below 20 mg.

STABILILTY AFTER PUMPING - After the finish is recirculated through the Micropump ®, the finish is allowed to stand for one week at 20°-25° C. Any signs of separation, settling, creaming, or coagulation are noted.

THERMAL STABILITY - The freshly prepared finish is placed in a sealed jar and stored for 24 hours at 40°-45° C. Any signs of separation, settling, creaming, or coagulation are noted.

THICKENING ON STANDING - The viscosity of the freshly prepared finish is determined on a Brookfield ® Viscometer (model LVF) at 60 rpm. After standing at 20° to 25° C. for 14 days, the viscosity is again determined to quantify the extent of thickening or gelling of the finish. The typical finish of the invention as prepared has a viscosity of 3-6 centipoise and is within 2 centipoise of that original value after standing for 14 days.

In the examples which follow, as elsewhere in the specification, parts and percentages are by weight unless otherwise indicated.

EXAMPLES 1-38

The following Example 1 demonstrates the effectiveness of a fluorochemical finish composition of the invention when used as a secondary (overlay) finish for manufacturing a bulked continuous filament carpet yarn of nylon-6,6 in a coupled spin-draw-bulk process.

Poly(hexamethylene adipamide) having an average number molecular weight of about 15,000 is melt spun in a conventional manner through a spinneret to provide 80 filaments having a trilobal cross-section with a modification ratio of about 1.75. The molten filaments are solidified in a conventional manner using a cross-flow air quenching apparatus prior to contacting a feed roll. Prior to the feed roll, a primary (spin) finish composition is applied to the freshly solidified undrawn filaments by means of a conventional rotating finish roll which is partly immersed in a pan containing the finish. The speed of the rotation of the finish roll is such that it provides the spun filaments with about 0.4% finish solids on yarn. The composition of the primary (spin) finish is 90% deionized water, 8.8% polyethylene glycol and derivatives, and 1.2% ethoxylated castor oil, adjusted to a pH of 8-9 with potassium hydroxide.

The yarn is drawn in a continuous operation over two pairs of conventional draw pins by a pair of draw rolls heated at 190° C. to a draw ratio of 2.9X and then bulked according to Breen and Lauterbach, U.S. Pat. No. 3,781,949, in a hot air bulking jet at a temperature of 210° C. and at a hot air pressure of 120 psig. After bulking, the yarn proceeds to a conventional take-up roll and wind-up. A fluorochemical finish composition (as an overlay or secondary finish) is then applied to the yarn between the take-up roll and the wind-up by continuously metering the finish through an orifice across which the yarn is running. Approximately 0.8% secondary or overlay finish on a solids basis is applied to the yarn.

The fluorochemical finish of Example 1 is prepared by tank mixing a combination of deionized water, and an emulsion of the surfactants with the FA-1 fluorochemical textile antisoilant, followed by addition of the L-452 as a lubricant, and additional surfactants with a shaft-driven propeller until well mixed. The pH is adjusted to a 4.0±0.5 with phosphoric acid and thoroughly mixed. A portion of the aqueous emulsion is added slowly to the finish applicator tank and thoroughly mixed before metering onto the yarn.

An aqueous emulsion of FA-1 is prepared by adding 28.6 pounds of a solution of 67% fluorocarbonylimino biuret in 33% methyl isobutyl ketone (MIBK) to an aqueous solution of 60 pounds of water, 0.3 pound of Arquad ® 12-50, and 0.1 pound of Merpol ® HCS at 50° C. The mixture is steam distilled to reduce the MIBK to less than 0.5% in the mixture. Water is added to obtain a final solids concentration of 20% and the mixture is cooled over 12 hours. The fluorocarbonylimino biuret is prepared in accordance with Example 6 of U.S. application Ser. No. 06/644,089 now U.S. Pat. No. 4,958,039 filed Aug. 24, 1984, by condensing a fluoroalcohol mixture with 1,3,5-tris(6-isocyanotohexyl) biuret followed by modification with 3-chloro-1,2-propanediol.

A ply-twisted yarn is prepared from the yarn which has been treated with fluorochemical finish composition, using a balanced singles yarn and ply-twist of 3.5 turns per inch, Z/S, and ply-twist heatset in a conventional manner in the "Superba" process at 280° F. The ply-twisted yarns are tufted into a carpet backing using 5.32 inch gauge to produce a carpet weight of 32 ounces per square yard tufted at ½ inch pile height. The carpet is dyed in a Beck at pH 9 at 10 yards per minute using 0.3% Acetamine Yellow CG dye. Analyses of the yarn show about 400 ppm fluorine.

A second control carpet is made from yarn prepared without any antisoil finish. The secondary finish is a composition of 85% water, 11.3% coconut oil, and 3.7% ethoxylated castor oil.

The antisoil performances of the control and the antisoil treated carpet are tested in a conventional floor test subject to normal foot traffic in a busy corridor and traffic exposure of the samples is counted. Soiling performance is evaluated through visually rating the samples versus a calibrated scale to observe the change of appearance of the carpets with traffic exposure. The scale consists of identical carpet samples containing different levels of soil covering the Tristimulus $\Delta E$ reflectance values from 0 to 26 in six equal intervals where $\Delta E=0$ is an unsoiled sample.

After 160,000 traffic cycles, the untreated control is rated as 6.0 and the antisoil treated carpet is rated as 4.0 showing it to perform better.

Example 1 is meant to be representative of the nature of the invention. The choice of lubricant and antisoil fluorochemical in this Example represent a preferred fluorochemical finish composition for secondary finish application to a continuous filament yarn of nylon-6,6. Various adaptations of this invention, e.g. to nylon staple, polypropylene, or polyester yarns and/or for use as a primary or spin finish will be apparent to those skilled in the art of textile fiber finishes and treatments without departing from the scope and spirit of the invention.

In the following Table I, the results are summarized for Example 1 along with 37 similarly prepared compositions of the invention as well as a control compositions not of the invention. The compositions are composed on a weight percent basis, respectively, of water, and the following active ingredients on a dry weight basis: fluorochemical textile antisoilant, lubricant, nonionic surfactant and cationic surfactant. The compositions are tested, respectively, to measure pump deposits in milligrams, for stability after pumping (in this regard "fines", i.e. a small amount of settling is not objectionable), for thermal stability at 45° C. and for thickening after standing. In all cases the compositions are adjusted, if necessary, to have a pH below 6. In some cases sulfamic acid is used to adjust the pH, but the choice of acid is not critical provided it is not a fatty acid.

It will be noted the control suffers from problems of instability upon pumping, thermal instability, and it also thickens excessively, as evidence by a viscosity increase from 5.6 centipoise as prepared to 142 centipoise after standing 14 days at 20°-25° C. By comparison Examples 2 and 3 are tested and found to remain virtually unchanged below 6 centipoise during the same period.

TABLE I

| | Active Ingredient (AI) | | | | | Tests | | | |
|---|---|---|---|---|---|---|---|---|---|
| Example | % AI | F-Chem | Lubricant | Surfactant Nonionic | Surfactant Cationic | Pump Deposits | Stable Pump | Thermal Stability | Thickens |
| 1 | 17% | 12.4% FA-1 | 82.4% L-452 | 2.3% Merpol HCS | 2.9% Arquad 12-50 | 6 | Yes | Yes | No |
| 2 | 17% | 12.3% FA-1 | 81.9% L-408 | 2.9% Merpol HCS | 2.9% Arquad 12-50 | 7 | Yes | Yes | No |
| 3 | 17% | 12.2% FA-1 | 81.6% L-452 | 5.8% Merpol HCS | 0.4% Arquad 12-50 | 3 | Yes | Yes | No |
| 4 | 17% | 12.2% FA-1 | 81.6% L-67 | 5.8% Merpol HCS | 0.4% Arquad 12-50 | 7 | Yes | Yes | No |
| 5 | 17% | 12.2% FA-1 | 81.6% L-95 | 5.8% Merpol HCS | 0.4% Arquad 12-50 | 10 | Yes | Yes | No |
| 6 | 17% | 12.2% FA-1 | 81.6% L-61 | 5.8% Merpol HCS | 0.4% Arquad 12-50 | 13 | Yes | Yes | No |
| 7 | 16% | 12.5% FA-1 | 81.3% L-408 | 3.1% Merpol HCS | 3.1% Arquad 12-50 | 18 | Yes | Yes | No |
| 8 | 20% | 12.7% FA-1 | 81.2% L-408 | 3.1% Merpol HCS | 3.0% Arquad 12-50 | 14 | Yes | Yes | No |
| 9 | 24% | 12.2% FA-1 | 81.6% L-408 | 2.9% Merpol HCS | 3.3% Arquad 12-50 | 11 | Yes | Yes | No |
| 10 | 28% | 12.4% FA-1 | 81.6% L-408 | 2.8% Merpol HCS | 3.2% Arquad 12-50 | 13 | Yes | Yes | No |
| 11 | 16% | 12.5% FA-1 | 81.3% L-452 | 3.1% Merpol HCS | 3.1% Arquad 12-50 | 12 | Yes | Yes | No |
| 12 | 20% | 12.7% FA-1 | 81.2% L-452 | 3.1% Merpol HCS | 3.0% Arquad 12-50 | 14 | Yes | Yes | No |
| 13 | 24% | 12.2% FA-1 | 81.6% L-452 | 2.9% Merpol HCS | 3.3% Arquad 12-50 | 15 | Yes | Yes | No |
| 14 | 28% | 12.4% FA-1 | 81.6% L-452 | 2.8% Merpol HCS | 3.2% Arquad 12-50 | 12 | Yes | Yes | No |
| 15 | 17% | 13.1% FA-1 | 81.1% L-452 | 5.3% Brij 35 0.1% Merpol HCS | 0.4% Arquad 12-50 | 6 | Yes | Yes | No |
| 16 | 17% | 13.1% FA-1 | 81.1% L-452 | 5.3% Brij 58 0.1% Merpol HCS | 0.4% Arquad 12-50 | 15 | Yes | Yes | No |
| 17 | 17% | 13.1% FA-1 | 81.1% L-452 | 5.3% Brij 78 0.1% Merpol HCS | 0.4% Arquad 12-50 | 15 | Yes | Yes | No |
| 18 | 17% | 13.1% FA-1 | 81.1% L-452 | 5.3% Tween 80 0.1% Merpol HCS | 0.4% Arquad 12-50 | 3 | Yes | Yes | No |
| 19 | 17% | 13.2% FA-1 | 81.4% L-452 | 2.5% Merpol | 2.5% Arquad | 6 | Yes | Yes | No |

TABLE I-continued

| Example | Active Ingredient (AI) % AI | F-Chem | Lubricant | Surfactant Nonionic | Surfactant Cationic | Tests Pump Deposits | Stable Pump | Thermal Stability | Thickens |
|---|---|---|---|---|---|---|---|---|---|
| | | | | HCS | 12-33 0.4% Arquad 12-50 | | | | |
| 20 | 17% | 13.2% FA-1 | 81.4% L-452 | 2.5% Merpol HCS | 2.5% Arquad 16-29 0.4% Arquad 12-50 | 5 | Yes | Yes | No |
| 21 | 17% | 13.2% FA-1 | 81.4% L-452 | 2.5% Merpol HCS | 2.5% Arquad 2C-75 0.4% Arquad 12-50 | 2 | Yes | Yes | No |
| 22 | 17% | 13.1% FA-1 | 81.1% L-452 | 5.3% Merpol OJ 0.1% Merpol HCS | 0.4% Arquad 12-50 | 7 | Yes | Yes | No |
| 23 | 17% | 13.1% FA-1 | 81.1% L-452 | 5.3% Tween 60 0.1% Merpol HCS | 0.4% Arquad 12-50 | 7 | Yes | Yes | No |
| 24 | 17% | 13.1% FA-1 | 81.1% L-452 | 5.3% Igepal CA-720 0.1% Merpol HCS | 0.4% Arquad 12-50 | 6 | Yes | Yes | No |
| 25 | 17% | 13.1% FA-1 | 81.1% L-452 | 5.3% Igepal CO-850 0.1% Merpol HCS | 0.4% Arquad 12-50 | 5 | Yes | Yes | No |
| 26 | 17% | 13.1% FA-1 | 81.1% L-452 | 5.3% Igepal DM-710 0.1% Merpol HCS | 0.4% Arquad 12-50 | 6 | Yes | Yes | No |
| 27 | 25% | 27.7% FA-1 | 71.2% L-452 | 0.3% Merpol HCS | 0.8% Arquad 12-50 | 51 | Fines | Yes | No |
| 28 | 25% | 4.0% FA-1 | 95.9% L-452 | 0.04% Merpol HCS | 0.1% Arquad 12-50 | 6 | Yes | Yes | No |
| 29 | 10% | 29.6% FA-1 | 69.2% L-452 | 0.3% Merpol HCS | 0.9% Arquad 12-50 | 6 | Fines | Yes | No |
| 30 | 10% | 5.3% FA-1 | 94.5% L-452 | 0.05% Merpol HCS | 0.2% Arquad 12-50 | 9 | Yes | Yes | No |
| 31 | 17% | 17.5% FA-1 | 81.8% L-408 | 0.2% Merpol HCS | 0.5% Arquad 12-50 | 14 | Yes | Yes | No |
| 32 | 17% | 13.2% FA-1 | 86.3% L-408 | 0.1% Merpol HCS | 0.5% Arquad 12-50 | 23 | Fines | Yes | No |
| 33 | 17% | 12.3% FA-1 | 81.9% L-408 | 2.7% Merpol HCS | 3.1% Arquad 12-50 | 7 | Yes | Yes | No |
| 34 | 17% | 11.5% FA-1 | 74.7% L-408 | 6.9% Merpol HCS | 6.9% Arquad 12-50 | 8 | Yes | Yes | No |
| 35 | 17% | 10.4% FA-1 | 69.4% L-408 | 9.8% Merpol HCS | 10.4% Arquad 12-50 | 6 | Yes | Yes | No |
| 36 | 16% | 10.0% FA-2 | 81.2% L-452 | 3.8% Merpol HCS | 3.8% Arquad 12-50 1.2% Armeen DM-18D | 11 | Fines | Yes | No |
| 37 | 19% | 25.8% FA-3 | 67.0% L-452 | 3.1% Merpol HCS | 3.1% Arquad 12-50 1.0% Armeen DM-18D | 6 | Fines | Yes | No |
| 38 | 17% | 11.5% FA-4 | 80.5% L-452 | 3.4% Merpol HCS | 3.4% Arquad 12-50 1.2% Armeen DM-18D | 8 | Yes | Yes | No |
| Control A | 17% | 17.5% FA-1 | 71.1% L-408 | 4.0% Caprolactam 0.1% Merpol HCS 6.7% F-7 | 0.4% Arquad 12-50 | 22 | (*) | (*) | Yes |

(*) Separated

KEY TO ABBREVIATIONS

EO - Ethylene oxide units
PO - Propylene oxide units
PEG - Polyethylene glycol
L-408 - Glycerol monooleate (C9)/16 EO and 10 PO HLB=16
F7—F—$(CF_2—CF_2)_n$—$CH_2CH_2O$—$(CH_2CH_2O)_x$—H where n=3-8 and x=7 HLB=15
Merpol HCS - C12/C16 alcohol/15 EO HLB=15
Arquad 12-50 - Trimethyldodecylammonium chloride HLB=17
L-452 - PEG-600 monolaurate (C12) HLB=16
L-67 - PEG 400 monopelargonate (C9), methoxy capped HLB=14
L-95 - Random copolymer of 75/25:EO/PO HLB=14
L-61 - Pelargonic acid/9EO plus 1PO HLB=14
Brij 35 - Lauryl alcohol/23 EO HLB=17
Brij 58 - Cetyl (C16) alcohol/20 EO HLB=16
Brij 78 - Stearyl alcohol/20 EO HLB=15

Tween 80 - Sorbitan monooleate/20 EO HLB=15
Tween 60 - Sorbitan monostearate (C18)/20 EO HLB=15
Merpol OJ - Oleyl (C9) alcohol/10 EO HLB=13
Igepal CA-720 - Nonylphenol/12.5 EO HLB=15
Igepal DM-710 - Dialkylphenol/15 EO HLB=13
Arquad 12-33 - Trimethyldodecylammonium chloride HLB=17
Arquad 16-29 - Trimethylhexadecylammonium chloride HLB=16
Arquad 2C-75 - Dimethyldicocoammonium chloride HLB=11
FA-1 - Fluorochemical biuret
FA-2 - Fluorochemical citrate ester; emulsified with Armeen DM-18D
FA-3 - Fluorochemical citrate urethane containing 18% methylmethacrylate polymer to enhance durability; emulsified with Armeen DM-18D
FA-4 - Fluorochemical copolymer of perfluoroalkyl methacrylate:alkyl methyl methacrylate (74:26 weight ratio) emulsified with Armeen DM-18D
Igepal CO-850 - Nonylphenol/20 EO HLB=16
Armeen DM-18D - Dimethyl octadecylammonium acetate

What is claimed is:

1. A fluorochemical finish composition for imparting antisoiling protection and lubricity to textile fibers and which is stable to the high shear environment of a finish application system, said composition having a pH less than 6 and being a uniform aqueous emulsion containing about 2 to 30 weight % active ingredients and being substantially free of fluorine-containing surfactants, said active ingredients comprising on a dry solids weight basis about:

(a) 1 to 35% of nonionic fluorochemical textile antisoilant;

(b) 65 to 95% of nonionic water-soluble or water-emulsifiable lubricant;

(c) 0.05 to 15% of quaternary ammonium or protonated amine cationic surfactant; and (d) 0.05 to 15% of nonionic surfactant; the weight ratio of antisoilant to total surfactants being about 0.5 to 20:1 and the weight ratio of lubricant to antisoilant being about 2 to 25:1.

2. Composition according to claim 1 wherein the fluorochemical textile antisoilant is selected from the group consisting of a fluorocarbonylimino biuret, a fluoroester, a fluoroester carbamate, and a fluoropolymer.

3. Composition according to claim 2 wherein the fluorochemical textile antisoilant is a fluorocarbonylimino biuret.

4. Composition according to claim 1 wherein the lubricant is a water-soluble lubricant.

5. A textile fiber having incorporated therewith the fluorochemical finish composition of claim 1.

6. A textile fiber having incorporated therewith the fluorochemical finish composition of claim 2.

7. A textile fiber having incorporated therewith the fluorochemical finish composition of claim 3.

8. A polyamide textile fiber having incorporated therewith the fluorochemical finish composition of claim 1.

9. A polyamide textile fiber having incorporated therewith the fluorochemical finish composition of claim 2.

10. A polyamide textile fiber having incorporated therewith the fluorochemical finish composition of claim 3.

11. A carpet composed of pile fibers according to claim 5.

* * * * *